US011136867B2

(12) United States Patent
Robey et al.

(10) Patent No.: US 11,136,867 B2
(45) Date of Patent: Oct. 5, 2021

(54) PERFORATING GUN

(71) Applicant: HALLIBURTON ENERGY SERVICES, INC., Houston, TX (US)

(72) Inventors: Richard Ellis Robey, Mansfield, TX (US); Joseph Todd Macgillivary, Fort Worth, TX (US); Jason Paul Metzger, Joshua, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/639,504

(22) PCT Filed: Nov. 15, 2017

(86) PCT No.: PCT/US2017/061850

§ 371 (c)(1),
(2) Date: Feb. 14, 2020

(87) PCT Pub. No.: WO2019/099005

PCT Pub. Date: May 23, 2019

(65) Prior Publication Data

US 2021/0032963 A1 Feb. 4, 2021

(51) Int. Cl.

| | |
|---|---|
| ***E21B 43/119*** | (2006.01) |
| ***E21B 43/117*** | (2006.01) |
| ***F42D 1/02*** | (2006.01) |

(52) U.S. Cl.

CPC ..... *E21B 43/1193* (2020.05); *E21B 43/117* (2013.01); *F42D 1/02* (2013.01)

(58) Field of Classification Search

CPC ..... E21B 17/06; E21B 23/04; E21B 23/0414; E21B 43/117; E21B 43/119; E21B 43/1193; F42D 1/02

See application file for complete search history.

(56) References Cited

U.S. PATENT DOCUMENTS

| | | | | |
|---|---|---|---|---|
| 2,818,808 A * | 1/1958 | Dill | ..... | E21B 43/117 175/4.6 |
| 4,633,951 A | 1/1987 | Hill et al. | | |
| 4,685,516 A * | 8/1987 | Smith | ..... | E21B 17/023 166/385 |
| 5,477,785 A | 12/1995 | Dieman, Jr. et al. | | |

(Continued)

FOREIGN PATENT DOCUMENTS

| | | | | |
|---|---|---|---|---|
| WO | 2013032991 A2 | 3/2013 | | |
| WO | WO-2013032456 A1 * | 3/2013 | ..... | E21B 43/119 |

OTHER PUBLICATIONS

Flow Through Perforating System; IPS 14-34; Baker Hughes Incorporated; 2012.

(Continued)

*Primary Examiner* — Jennifer H Gay
(74) *Attorney, Agent, or Firm* — Polsinelli PC

(57) ABSTRACT

A perforating gun including a carrier having a longitudinal length, one or more energetic devices received within the carrier configured to produce one or more mechanical waves, and one or more wave manipulators disposed along the longitudinal length of the carrier. The one or more wave manipulators generate an altered wave in an opposite travel direction of one or more mechanical waves traveling along the longitudinal length of the carrier.

16 Claims, 14 Drawing Sheets

(56) References Cited

U.S. PATENT DOCUMENTS 6,422,148 B1 * 7/2002 Xu ..... E21B 43/1193 102/313
8,714,252 B2 * 5/2014 Glenn ..... G06F 30/17 166/297
8,794,335 B2 8/2014 Fadul et al.
8,881,816 B2 * 11/2014 Glenn ..... E21B 43/11 166/297
9,091,152 B2 * 7/2015 Rodgers ..... E21B 43/1195
9,598,940 B2 * 3/2017 Rodgers ..... E21B 43/117
2009/0151589 A1 * 6/2009 Henderson ..... E21B 17/07 102/333
2012/0273201 A1 * 11/2012 Glenn ..... E21B 43/117 166/297
2012/0318508 A1 * 12/2012 Glenn ..... G06F 30/17 166/297
2013/0048375 A1 * 2/2013 Rodgers ..... E21B 43/1195 175/4.6
2013/0048376 A1 * 2/2013 Rodgers ..... E21B 43/1195 175/4.6
2013/0118805 A1 5/2013 Moody-Stuart et al.
2013/0248184 A1 * 9/2013 Glenn ..... E21B 17/07 166/297
2014/0076564 A1 * 3/2014 Rodgers ..... E21B 43/117 166/298
2014/0076631 A1 * 3/2014 Rodgers ..... E21B 43/116 175/2
2014/0137723 A1 * 5/2014 Umphries ..... E21B 43/11855 89/1.15
2015/0376991 A1 12/2015 McNelis et al.
2021/0032963 A1 * 2/2021 Robey ..... E21B 43/117

OTHER PUBLICATIONS

Brinsden, Mark; "Propellant Disappearing Gun Concept Trials," IPS 14-41; perforators.org International Perforating Forum; Shell Global Solutions International B.V.;May 13, 2014.

Brinsden, Mark;"The Fragmenting Gun-An Entirely New Gun System," Middle East and North Africa Perforating Symposium; Muscat, Oman; MENAPS 16-15; Shell Global Solutions (UK); Nov. 13, 2016.

International Search Report and Written Opinion; PCT Application No. PCT/US2017/061850; dated Aug. 9, 2018.

French Search Report; French Application No. 1859418; dated Apr. 2, 2020.

* cited by examiner

PERFORATING GUN

CROSS-REFERENCE TO RELATED APPLICATIONS

This application is a national stage entry of PCT/US2017/061850 filed Nov. 15, 2017, said application is expressly incorporated herein in its entirety.

FIELD

The present application is directed to a separable perforating gun. More specifically, this application is directed to a separable perforating gun via wave manipulator.

BACKGROUND

Conventional perforating guns are utilized to assist in recovery of hydrocarbons from subterranean formations. Perforating guns are loaded with one or more energetic charges and then positioned within a wellbore into subterranean formation desired to perforate. Upon completion, the perforating gun must either be removed from the wellbore, delaying production or dropped to the bottom of the wellbore. Allowing the perforating gun to be dropped to the bottom of the wellbore requires a portion of the wellbore to extend beyond the desired perforating zone, thus extending drilling operations. Additionally, conventional perforating guns can become lodged or stuck within the wellbore during removal operations due to swelling during perforation, thus preventing production operations.

BRIEF DESCRIPTION OF THE DRAWINGS

Embodiments of the present application are described, by way of example only, with reference to the attached Figures, wherein.

DETAILED DESCRIPTION

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

It should be understood at the outset that although illustrative implementations of one or more embodiments are illustrated below, the disclosed compositions and methods may be implemented using any number of techniques. The disclosure should in no way be limited to the illustrative implementations, drawings, and techniques illustrated herein, but may be modified within the scope of the appended claims along with their full scope of equivalents.

Several definitions that apply throughout this disclosure will now be presented. The terms "comprising," "including" and "having" are used interchangeably in this disclosure. The terms "comprising," "including" and "having" mean to include, but are not necessarily limited to, the things so described.

The term "communicatively coupled" is defined as connected, either directly or indirectly through intervening components, and the connections are not necessarily limited to physical connections, but are connections that accommodate the transfer of data between the so-described components. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder.

The present disclosure provides wave manipulation fragmentable tool. The wave manipulation fragmentable tool can be utilized to perforate a subterranean formation, generating shocks to sever and/or fragment a tool, or both perforate a subterranean formation while generating shocks to fragment a tool, for example a perforating gun. While described below with respect to a fragmentable perforating gun, the present disclosure can be implemented with tool configured use within a subterranean formation and/or a wellbore.

Figure 1:
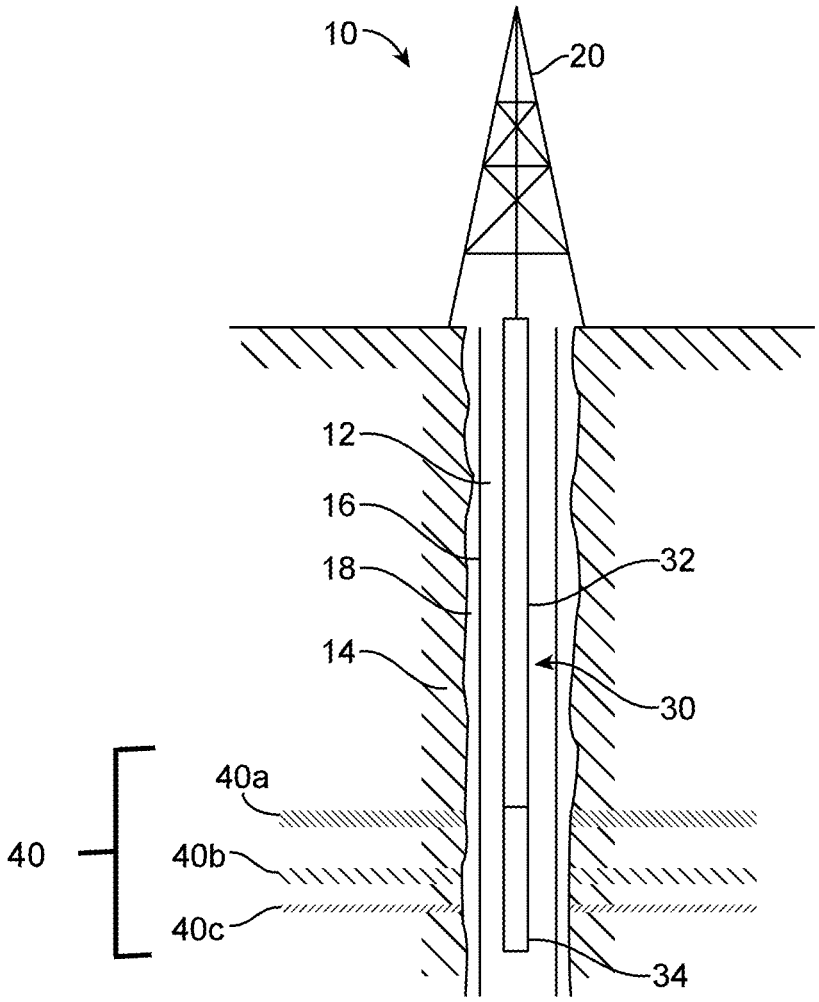
FIG. 1 is a diagrammatic view of a perforating gun disposed within a wellbore, according to the present disclosure.

FIG. 1 shows a diagrammatic view of a fragmentable perforating gun system. The fragmentable perforating gun system 10 can comprise servicing rig 20 that extends over and around a wellbore 12 that penetrates a subterranean formation 14 for the purpose of recovering hydrocarbons from a first production zone 40*a*, a second production zone 40*b*, and/or a third production zone 40*c*, collectively the production zones 40. The wellbore 12 may be drilled into the subterranean formation 14 using any suitable drilling technique. While shown as extending vertically from the surface in FIG. 1, the wellbore 12 may also be deviated, horizontal, and/or curved over at least some portions of the wellbore 12. For example, the wellbore 12, or a lateral wellbore drilled off of the wellbore 12, may deviate and remain within one of the production zones 40. The wellbore 12 may be cased, open hole, contain tubing, and may generally comprise a hole in the ground having a variety of shapes and/or geometries as is known to those of skill in the art. In the illustrated embodiment, a casing 16 may be placed in the wellbore 12 and secured at least in part by cement 18.

The servicing rig 20 may be one of a drilling rig, a completion rig, a workover rig, or other mast structure and supports a workstring 30 in the wellbore 12, but a different structure may also support the workstring, 30. The servicing rig 20 may also comprise a derrick with a rig floor through which the workstring 30 extends downward from the servicing rig 20 into the wellbore 12. In some embodiments, such as in an off-shore location, the servicing rig 20 may be supported by piers extending downwards to a seabed. Alternatively, in some embodiments, the servicing rig 20 may be supported by columns sitting on hulls and/or pontoons that are ballasted below the water surface, which may be referred to as a semi-submersible platform or rig. In an off-shore location, a casing 16 may extend from the servicing rig 20 to exclude sea water and contain drilling fluid returns. It is understood that other mechanical mechanisms, not shown, may control the run-in and withdrawal of the workstring 30 in the wellbore 12, for example a draw works coupled to a hoisting apparatus, another servicing vehicle, a coiled tubing unit and/or other apparatus.

In an embodiment, the workstring 30 may comprise a conveyance 32 and a perforation tool assembly 34. The conveyance 32 may be any of a string of jointed pipes, a slickline, a coiled tubing, and a wireline. In other embodiments, the workstring 30 may further comprise one or more downhole tools (not shown in FIG. 1), for example above the perforation tool assembly 34. The workstring 30 may comprise one or more packers, one or more completion components such as screens and/or production valves, sensing and/or measuring equipment, and other equipment which are not shown in FIG. 1. In some contexts, the workstring 30 may be referred to as a tool string or completion string. The workstring 30 may be lowered into the wellbore 12 to position the perforation tool assembly 34 to perforate the casing 16 and penetrate one or more of the production zones 40.

The system 10 is typically assembled on the field and individual charge tubes are inserted into gun bodies of the perforation gun assemblies by, for example, a gun loader. Each charge tube is assembled, for example by adding the charges, and then the charge tube is inserted into the gun body and aligned with the scallops of the gun body.

The perforation gun assembly 34 can be fragmentable to allow a plurality of pieces to be disposed to the bottom of the wellbore 12 without causing obstruction or requiring the wellbore 12 to be drilled a substantial extent beyond the producing zone 40.

Figure 2:
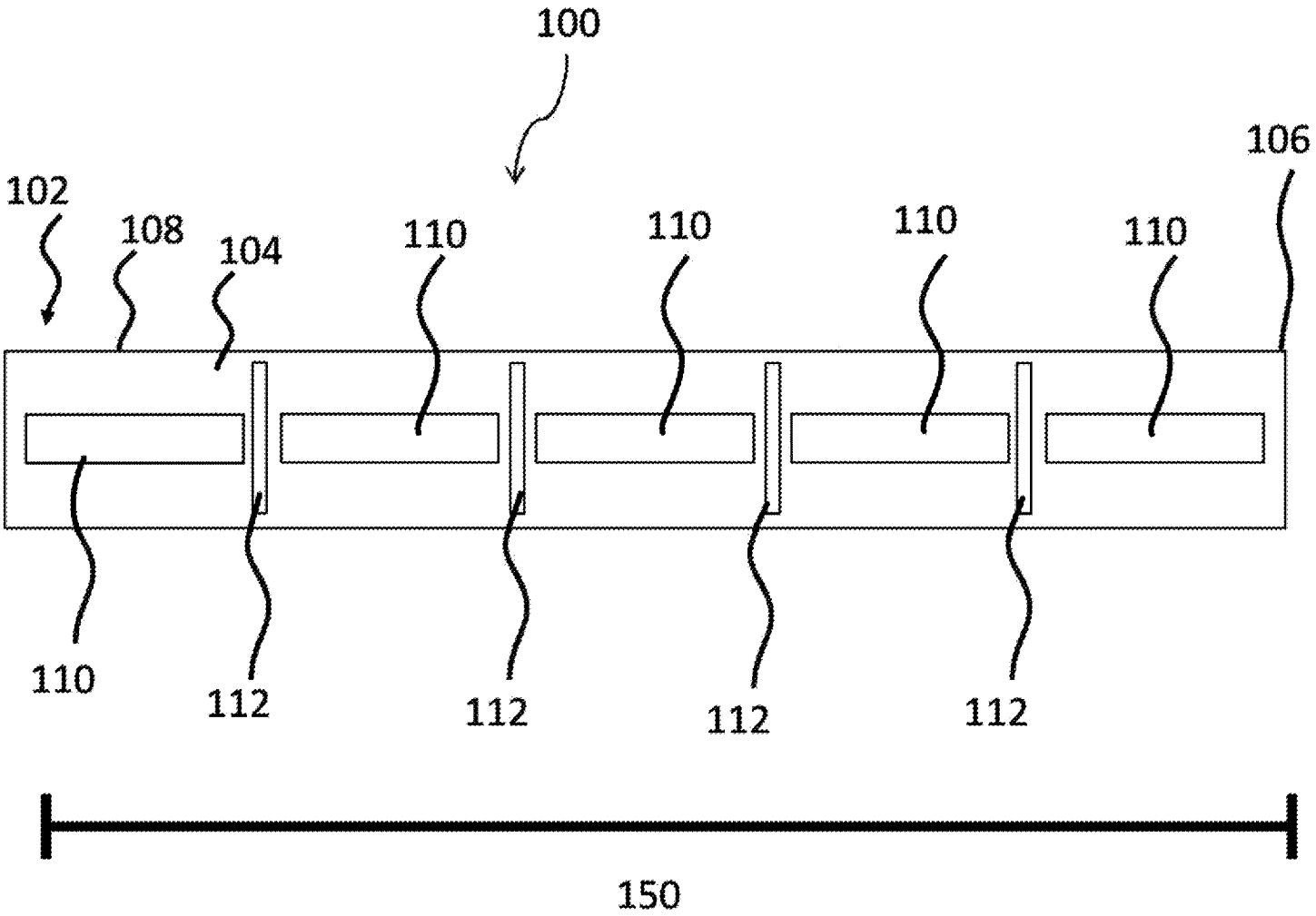
FIG. 2 is a diagrammatic view of fragmentable perforating gun, according to the present disclosure.

FIG. 2 shows a diagrammatic view of a fragmentable perforating gun. A fragmentable perforating gun 100 includes a carrier 102 extending a longitudinal length 150. The carrier 102 can have an inner portion 104 configured to receive additional elements. The inner portion 104 can be a bore extending along the longitudinal length 150 of the carrier 102. The inner portion 104 can have any desirable cross-sectional profile including, but not limited to, circular, ovular, hexagonal, octagonal, square, etc.

The carrier 102 can be substantially cylindrical for use in subterranean wellbore applications. The carrier 102 can alternatively be any shape depending on the desired use and application. The carrier sidewall thickness 106 can be defined between an exterior surface 108 of the carrier 102 and the inner portion 104. The sidewall thickness 106 can be consistent along the longitudinal length 150 of the carrier 102 and further consistent across the cross-sectional profile of the carrier 102. In at least one instance, the carrier 102 is substantially cylindrical and the inner portion 104 has a substantially circular cross-sectional profile with a consistent sidewall thickness 106 throughout the cross-sectional profile of the carrier 102. In other instances, the carrier 102 can be substantially ovular and the inner portion 104 can have a substantially circular cross-sectional profile resulting in a varying sidewall thickness 106 across the cross-sectional profile of the carrier 102.

The carrier 102 is configured to disintegrate, dissolve, fracture, burn, or otherwise separate. The carrier 102 can be formed from any number of materials including, but not limited to, steel, aluminum, magnesium, plastic, or any other frangible material that would aid in the fragmentation of the carrier 102.

One or more energetic devices 110 can be disposed within the inner portion 104 of the carrier 102. The one or more energetic devices 106 can be extend along the longitudinal length 150 of the carrier 102. The one or more energetic devices 110 can be activated to generate and propagate a mechanical wave (shown in FIGS. 2A-C) along the longitudinal length 150 of the carrier 102. In at least one instance, the mechanical wave is a shockwave. The one or more energetic devices 110 can be communicatively coupled or linked allowing sequential activation of each of the one or more energetic devices 110.

The one or more energetic devices 110 can be shaped charges determined by the wellbore environment, the desired fracture profile, and subterranean formation properties. The shaped charges can be conical, linear, or any other desirable shape. The one or more energetic devices 110 can also be explosive pellets, one or more detonation cords, or the like. The one or more energetic devices 110 can be any energetic material configured to propagate a mechanical wave along the longitudinal length 150 of the carrier 102.

The carrier 102 can further include one or more wave manipulators 112 disposed at discrete points along the longitudinal length 150 of the carrier 102. The one or more wave manipulators 112 can extend across the cross-sectional profile of the carrier 102 and substantially perpendicular to the longitudinal length 150. The mechanical wave generated by activation of at least one of the one or more energetic devices 110 can be altered or reflected by at least one of the one or more wave manipulators 112. The one or more wave manipulators 112 can be formed from a material configured to allow reflection of the mechanical wave in an opposite direction relative to the mechanical wave while also allowing a transmitted wave to continue along the longitudinal length 150 of the carrier 102. The one or more wave manipulators 112 can also be formed from or lined with a material configured to amplify the transmitted wave and the reflected wave.

FIGS. 3A-3D show a perforating gun fragmentable at one or more wave manipulators during operation according to the present disclosure. The perforating gun 100 has four wave manipulators 112 distributed substantially evenly along the longitudinal length 150 of the carrier 102. In other instances, the wave manipulators 112 can be distributed at varying lengths along the While four wave manipulators 112 are shown in FIGS. 3A-3D, one, two, three, five, six or any number of wave manipulators 112 can be implemented with perforating gun 100 depending on a number of factors including wellbore conditions and the longitudinal length 150 of the perforating gun 100.

The energetic devices 110 can be disposed within the carrier 102 and extend the longitudinal length 150. The one or more energetic devices 110 can be individual energetic devices separated by the wave manipulators 112 and energetically coupled together. The one or more energetic devices 110 can be a single energetic device 110 extending the longitudinal length 150 and extending through each of the one or more wave manipulators 112.

Figure 3A:
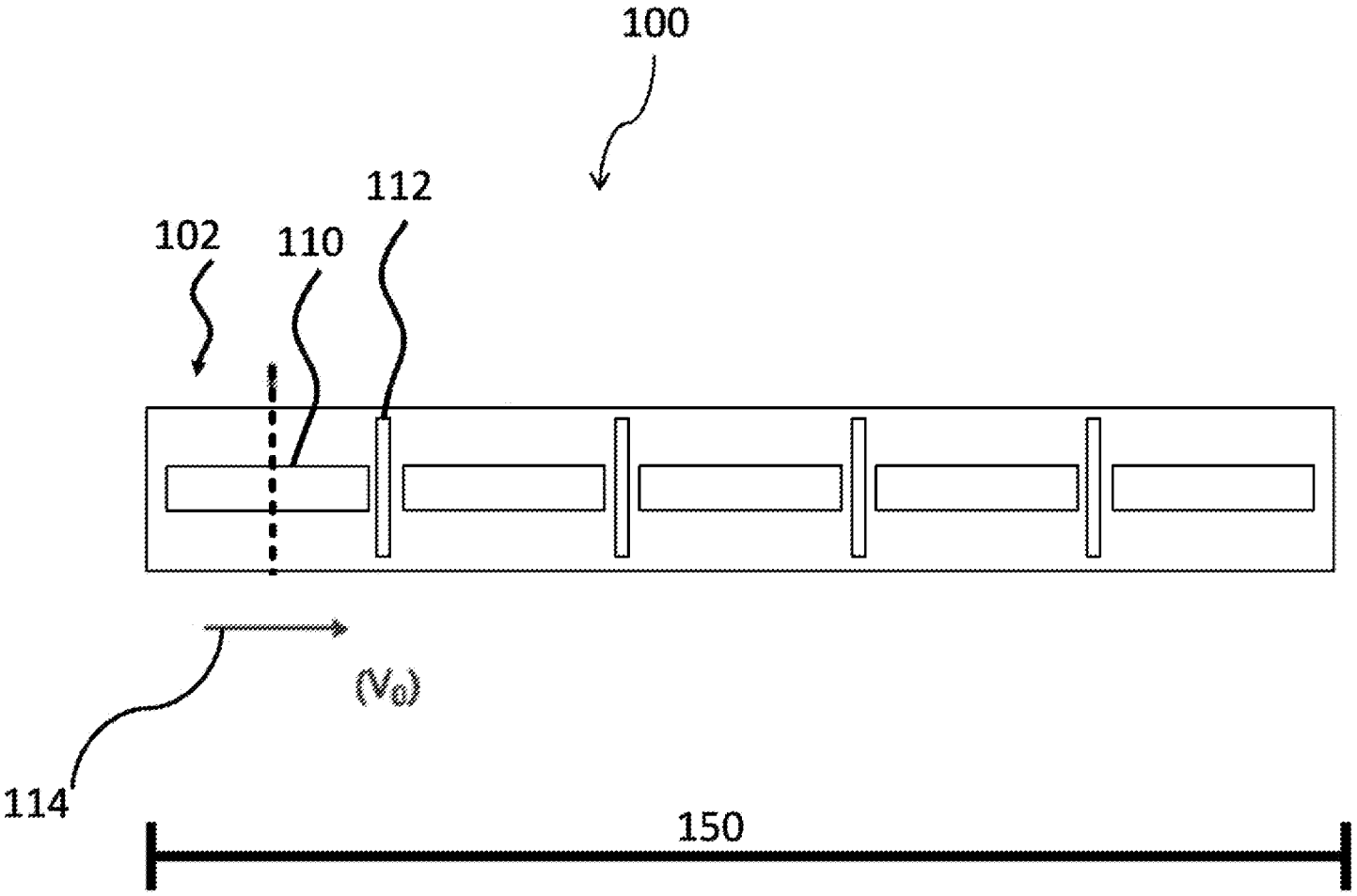
FIG. 3A is a diagrammatic view of fragmentable perforating gun detailing initial wave generation, according to the present disclosure.
Figure 3B:
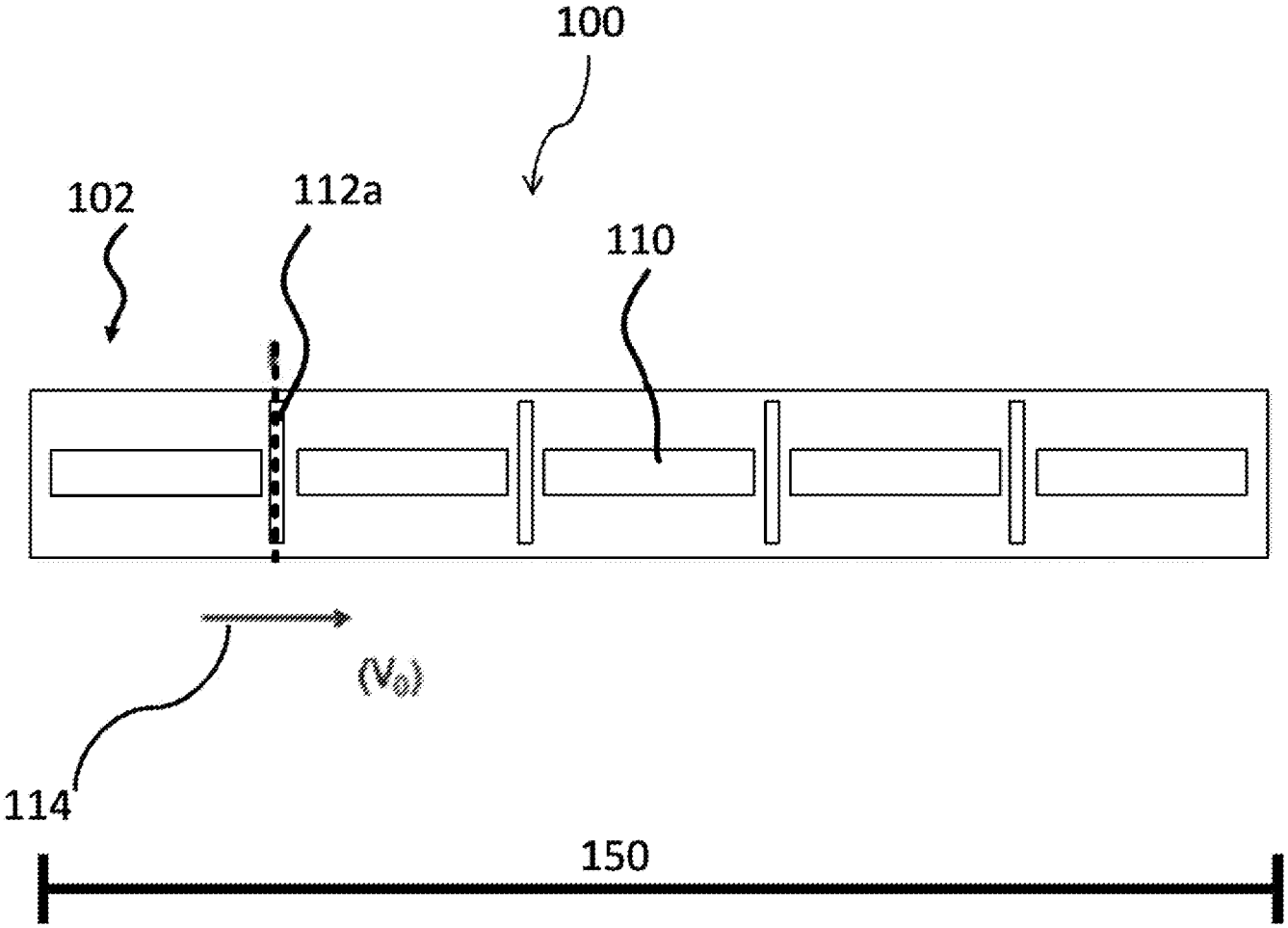
FIG. 3B is a diagrammatic view of fragmentable perforating gun detailing initial wave interaction with a wave manipulator, according to the present disclosure.

FIG. 3A shows the energization of energetic device 110 generating a shockwave 114 having an initial velocity ($V_0$). The shockwave 114 can be created by the use and/or operating of the energetic device 110. In at least one instance, the energetic device 110 is a detention cord that as energized generates the shockwave 114. The energetic device 110 can be remotely energized by a signal received from another location (e.g., the surface) or at a predetermined time after the perforating gun 100 has been properly positioned within the wellbore. The shockwave 114 propogates, or travels, along the longitudinal length 150 of the carrier 102. FIG. 3B shows the shockwave 114 interacting with a first wave manipulator 112*a*. The interaction between the shockwave 114 and the first wave manipulator 112*a* generates a reflected wave 116 (shown in FIG. 3C).

Figure 3C:
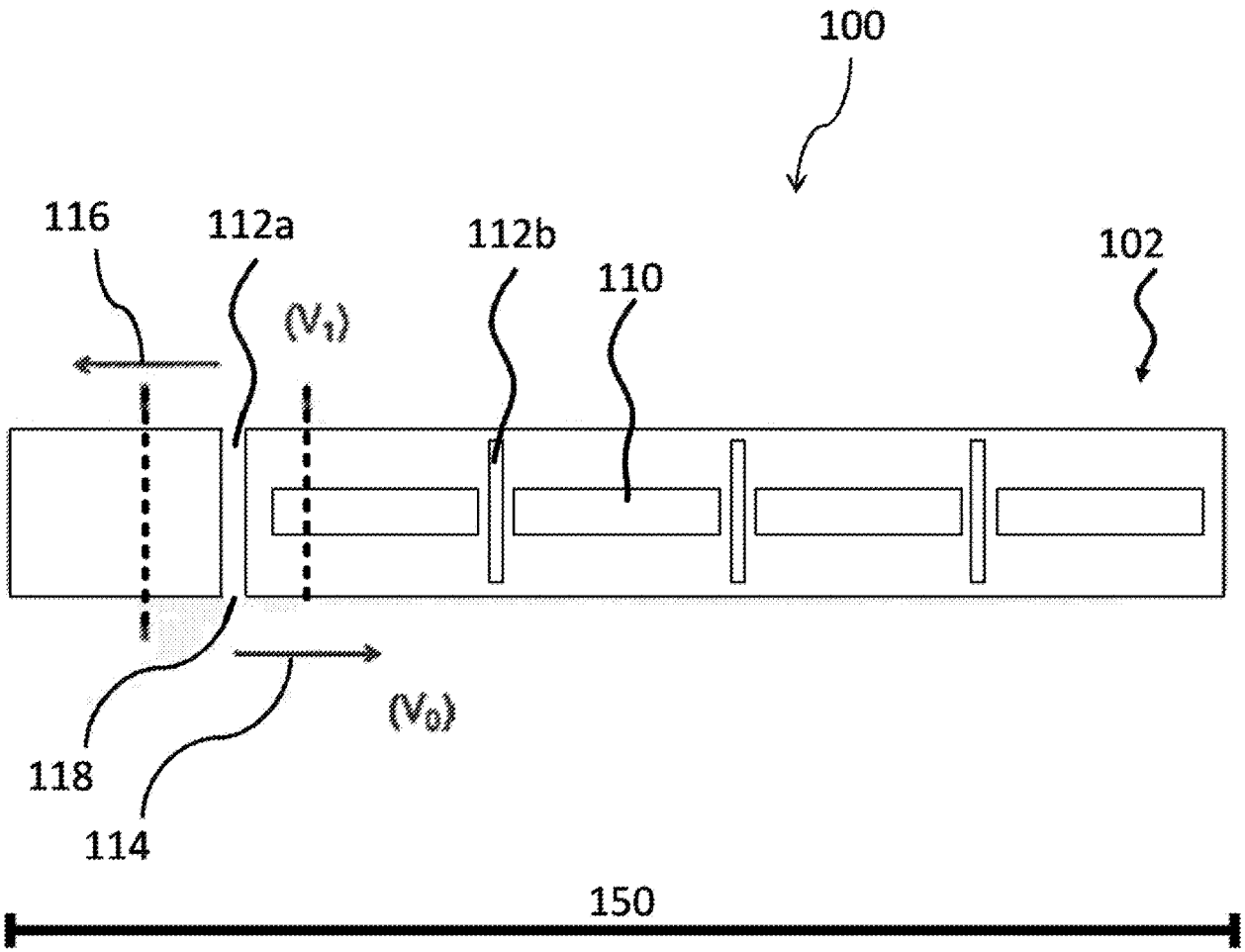
FIG. 3C is a diagrammatic view of fragmentable perforating gun detailing first fracture, according to the present disclosure.

FIG. 3C shows the perforating gun separating at the first wave manipulator 112. The interaction between the shockwave 114 and the first wave manipulator 112*a* generates the reflected wave 116 in a direction opposite the original travel direction of the shockwave 114. The reflected wave 116 travels at a velocity ($V_1$) in the direction opposite of the shockwave 114. The shockwave 114 and reflected wave 116 traveling in opposite directions induce a tensile load in the carrier 102. The tensile load induces a fracture 118, or separation, of the carrier 102 at the location of the first wave manipulator 112*a*. The fracture 118 is induced in the same plane as the wave manipulator 112 and at least substantially perpendicular to the longitudinal length 150 of the perforating gun 100.

The shockwave 114 continues traveling at the initial velocity ($V_0$) along the longitudinal length 150 of the carrier. The shockwave 114 travels as the energetic device 110 disposed between the first wave manipulator 112*a* and a second wave manipulator 112*b* is activated. As the shockwave 114 reaches the second wave manipulator 112*b*, the second wave manipulator 112*b* generates a reflected wave as described above. The reflected wave generated by the second wave manipulator 112*b* induces a second tensile load, thus causing a second fracture. The process continues along the longitudinal length 150 of the carrier, forming a fracture at each wave manipulator 112 within the carrier 102.

Figure 3D:
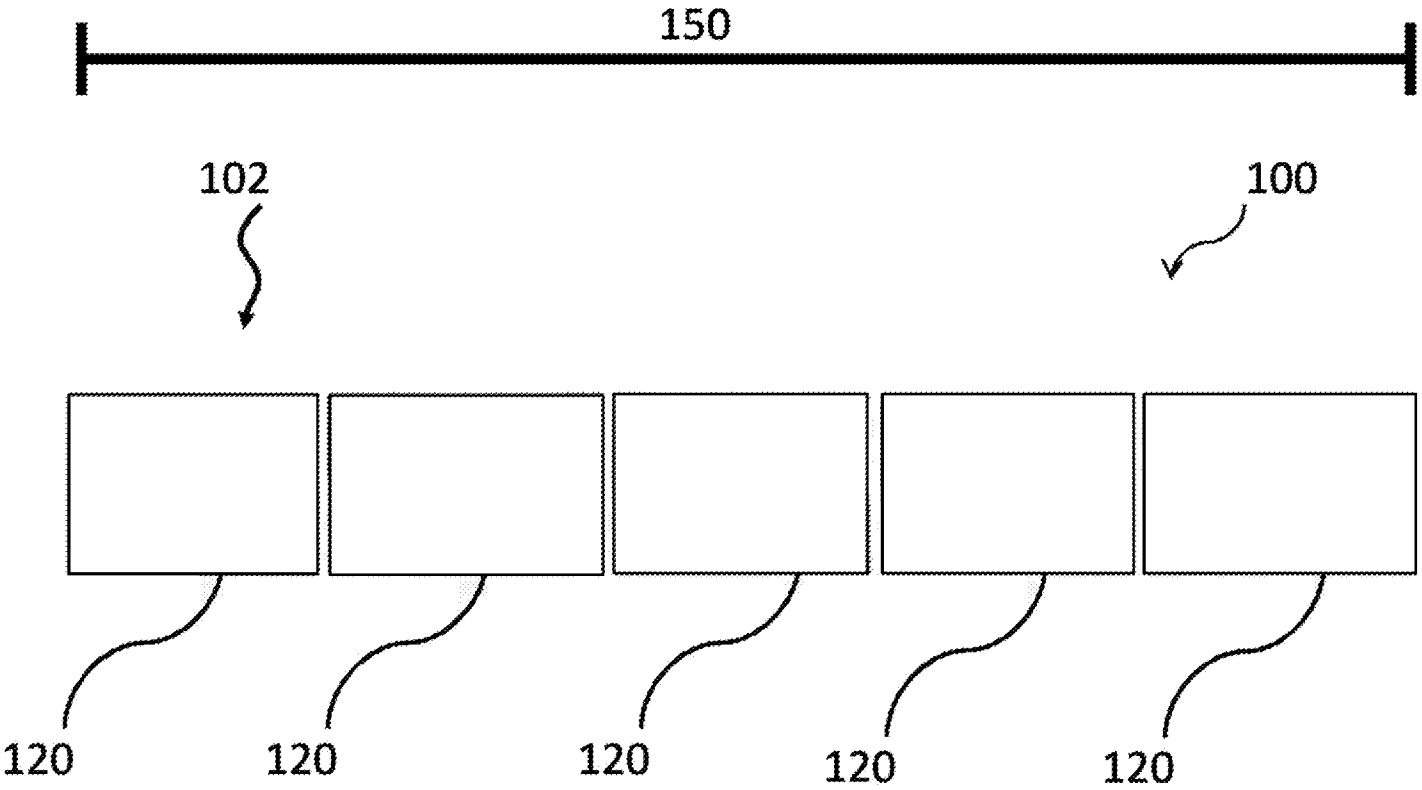
FIG. 3D is a diagrammatic view of fragmented perforating gun, according to the present disclosure.

FIG. 3D shows a separated perforating gun. The perforating gun 100 can be fractured, or separated, into a plurality of pieces 120 through the formation of fractures 118 at each wave manipulator 112 along the longitudinal length 150 of the carrier 102. The pieces 120 can be of any size depending on the number of wave manipulators 112 formed in the carrier 102 and the overall length and size of the perforating gun 100. The size and shape of the plurality of pieces 120 can vary depending on the shape of the one or more energetic devices 110, the material selection of the carrier 102, and/or the design of the one or more wave manipulators 112. The carrier is fractured, or separated, into pieces of sufficient size to prevent obstruction of the wellbore without having to remove the perforating gun 100. The plurality of pieces 120 can travel to the bottom of the wellbore, past the desired perforating zone.

FIGS. 4A-G show a perforating gun fragmentable at one or more wave manipulators and in between adjacent wave manipulators during operation according to the present disclosure. The perforating gun 200 has four wave manipulators 212 distributed substantially evenly along the longitudinal length 250 of the carrier 202. In other instances, the wave manipulators 212 can be distributed at varying lengths along the length 250 of the carrier 202. While four wave manipulators 212 are shown in FIGS. 4A-4H, one, two, three, five, six or any number of wave manipulators 212 can be implemented with perforating gun 200 depending on a number of factors including wellbore conditions and the longitudinal length 250 of the perforating gun 200.

The energetic devices 210 can be disposed within the carrier 202 and extend the longitudinal length 250. The one or more energetic devices 210 can be individual energetic devices separated by the wave manipulators 212 and energetically coupled together. The one or more energetic devices 110 can be a single energetic device 210 extending the longitudinal length 250 and extending through each of the one or more wave manipulators 212.

The one or more wave manipulators 212 can be configured to alter a shockwave 214 generated by the one or more energetic devices 210. In at least one instance, the one or more wave manipulators 212 can reflect at least a portion of the shockwave 214 generating a reflected wave 216 and transmit at least a portion of the shockwave 214 generating a transmitted wave 222.

Figure 4A:
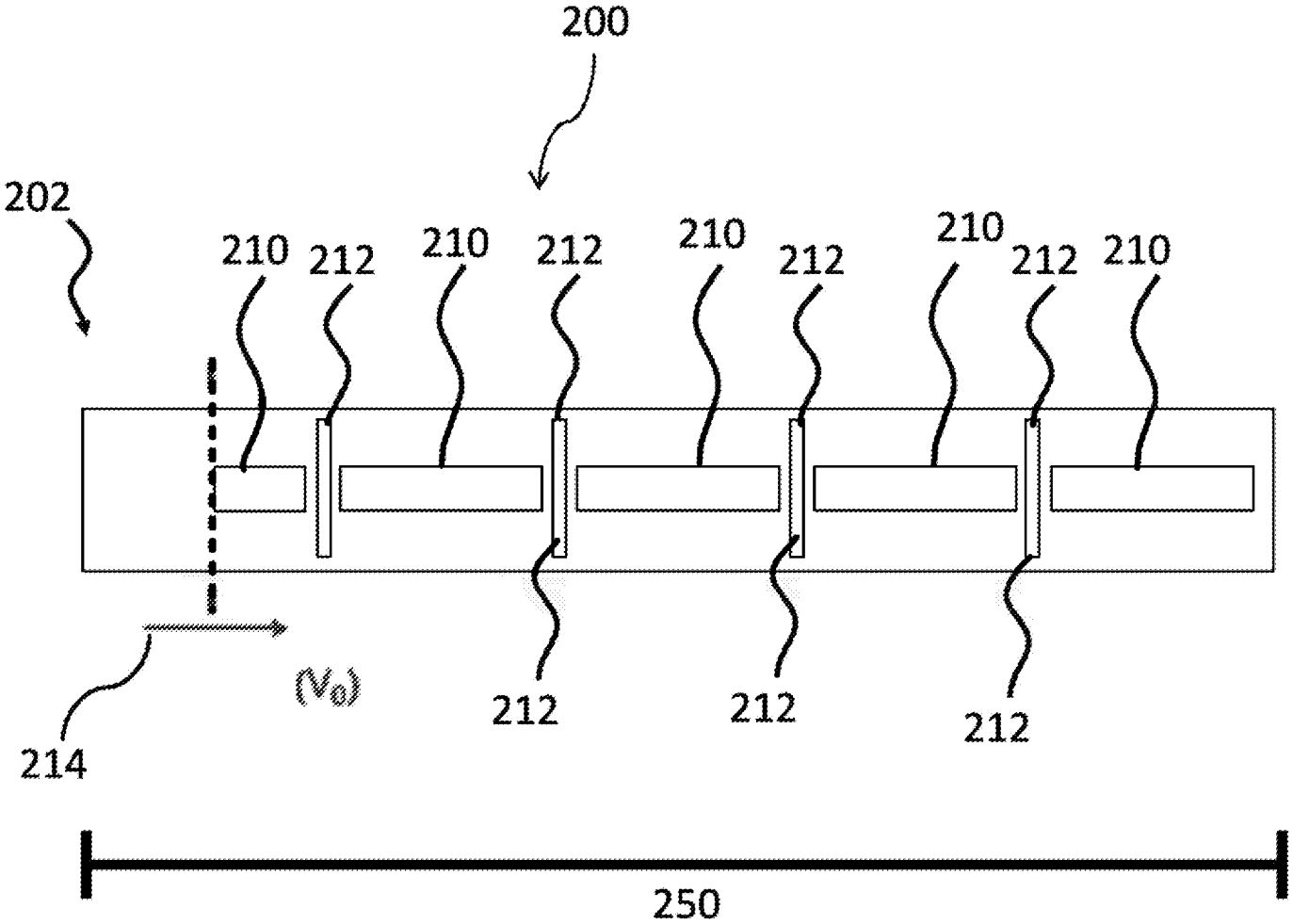
FIG. 4A is a diagrammatic view of fragmentable perforating gun detailing initial wave generation, according to the present disclosure.
Figure 4B:
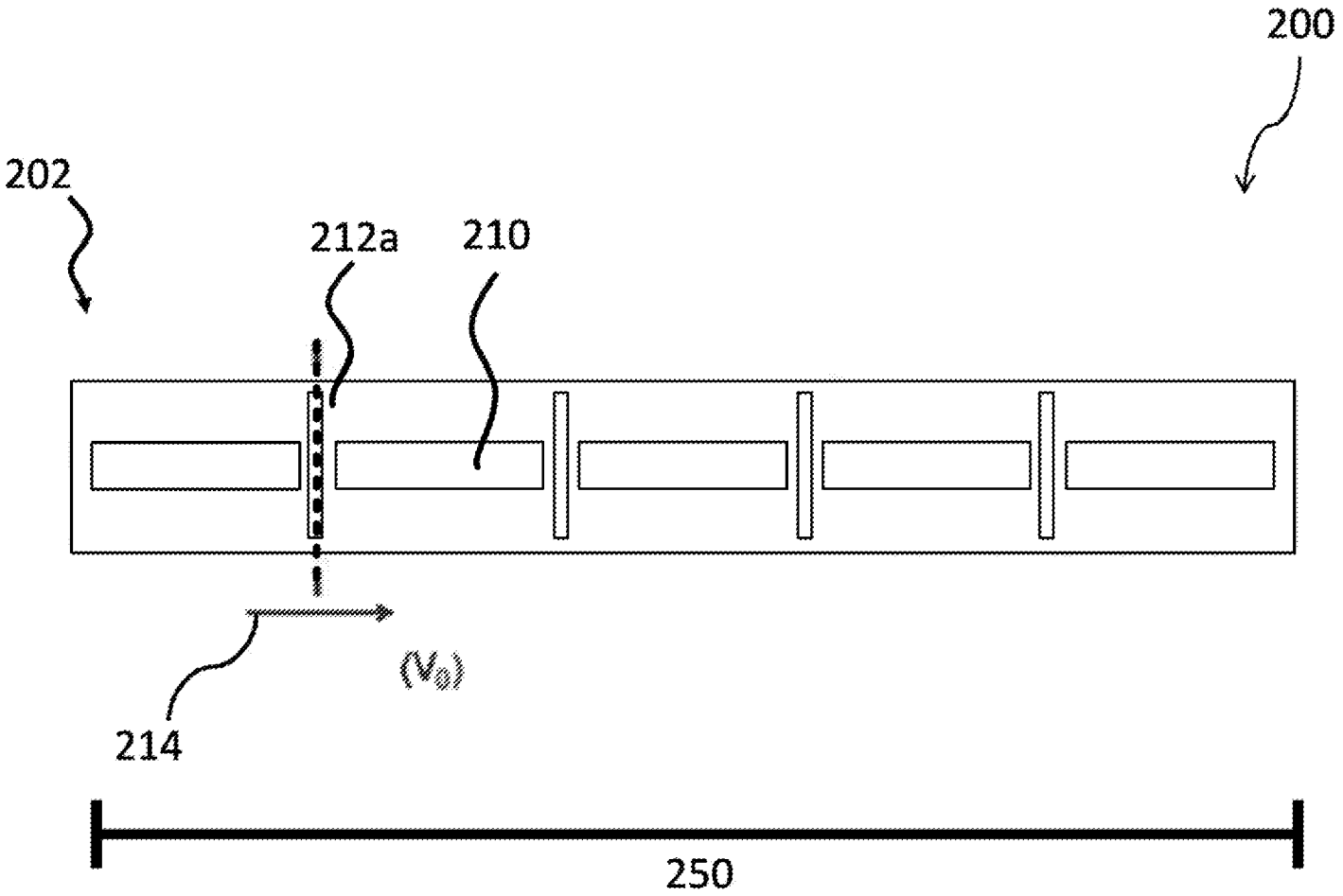
FIG. 4B is a diagrammatic view of fragmentable perforating gun detailing initial wave interaction with a wave manipulator, according to the present disclosure.

FIG. 4A shows the energization of energetic device 210 generating a shockwave 214 having an initial velocity ($V_0$). The shockwave 214 can be created by the use and/or operating of the energetic device 210. In at least one instance, the energetic device 210 is detention cord that as energized generates the shockwave 214. The energetic device 210 can be remotely energized by a signal received from another location (e.g., the surface) or at a predetermined time after the perforating gun 200 has been properly positioned within the wellbore. The shockwave 214 propagates, or travels, along the longitudinal length 250 of the carrier 202. FIG. 4B shows the shockwave 214 interacting with a first wave manipulator 212*a*. The interaction between the shockwave 214 and the first wave manipulator 212*a* generates a reflected wave 216 (shown in FIG. 4C).

Figure 4C:
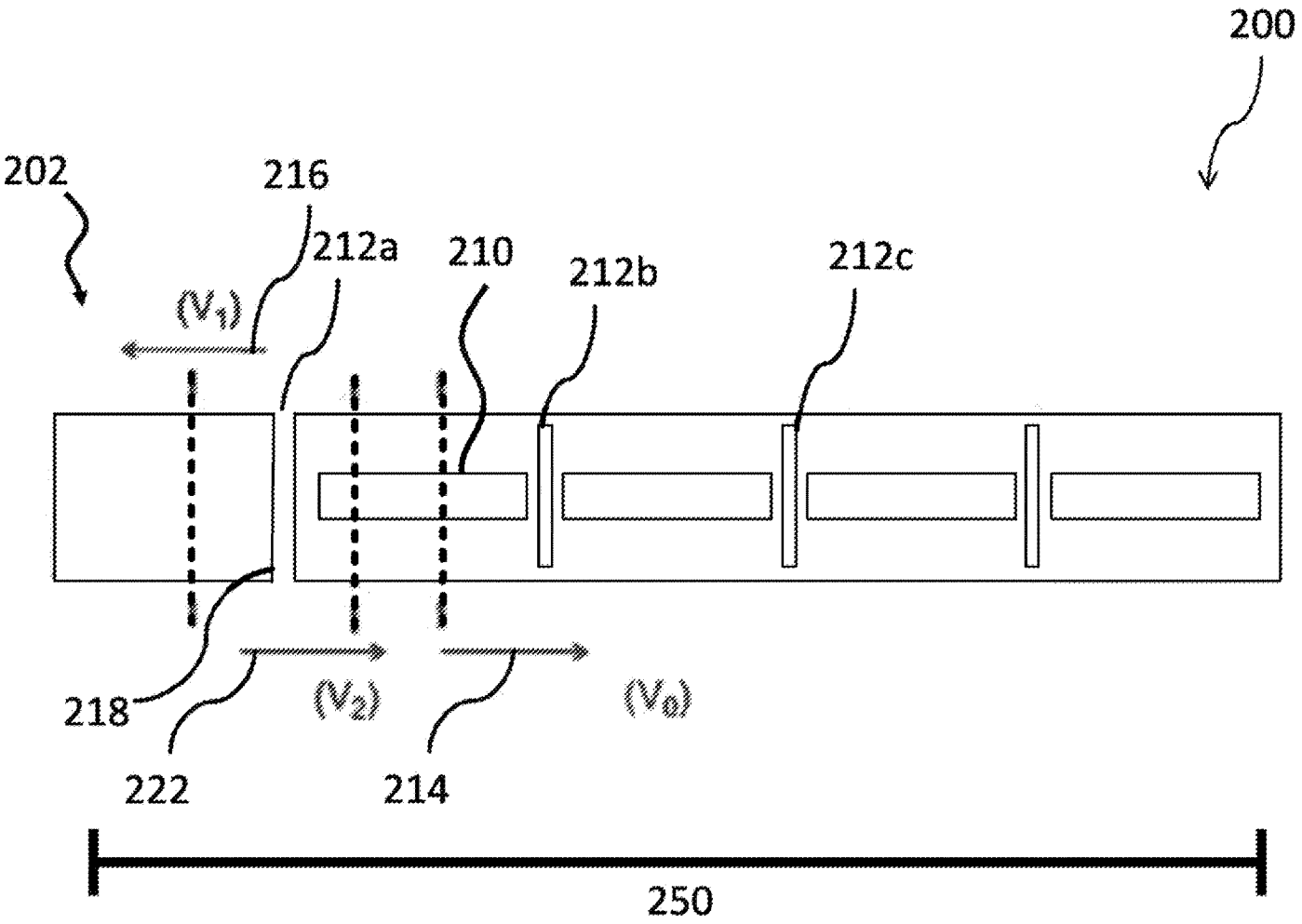
FIG. 4C is a diagrammatic view of fragmentable perforating gun detailing first fracture, according to the present disclosure.

FIG. 4C shows the perforating gun separating at the first wave manipulator 212*a*. The interaction between the shockwave 214 and the first wave manipulator 212*a* generates the reflected wave 216 in a direction opposite the original travel direction of the shockwave 214. The reflected wave 216 travels at a velocity ($V_1$) in the direction opposite of the shockwave 214. The shockwave 214 and reflected wave 216 traveling in opposite directions induce a tensile load in the carrier 202. The tensile load induces a fracture 218, or separation, of the carrier 202 at the location of the first wave manipulator 212*a*. The fracture 218 is induced in the same plane as the wave manipulator 212 and at least substantially perpendicular to the longitudinal length 250 of the perforating gun 200.

At least a portion of the shockwave 214 can also be transmitted by the first wave manipulator generating a transmitted wave 222 traveling at a velocity ($V_2$) along the longitudinal length 250 of the carrier 202. The transmitted wave 222 can travel in substantially the same direction as the shockwave 214. The shockwave 214 continues traveling at the initial velocity ($V_0$) along the longitudinal length 250 of the carrier and can be followed by the transmitted wave 222 at velocity ($V_2$).

Figure 4D:
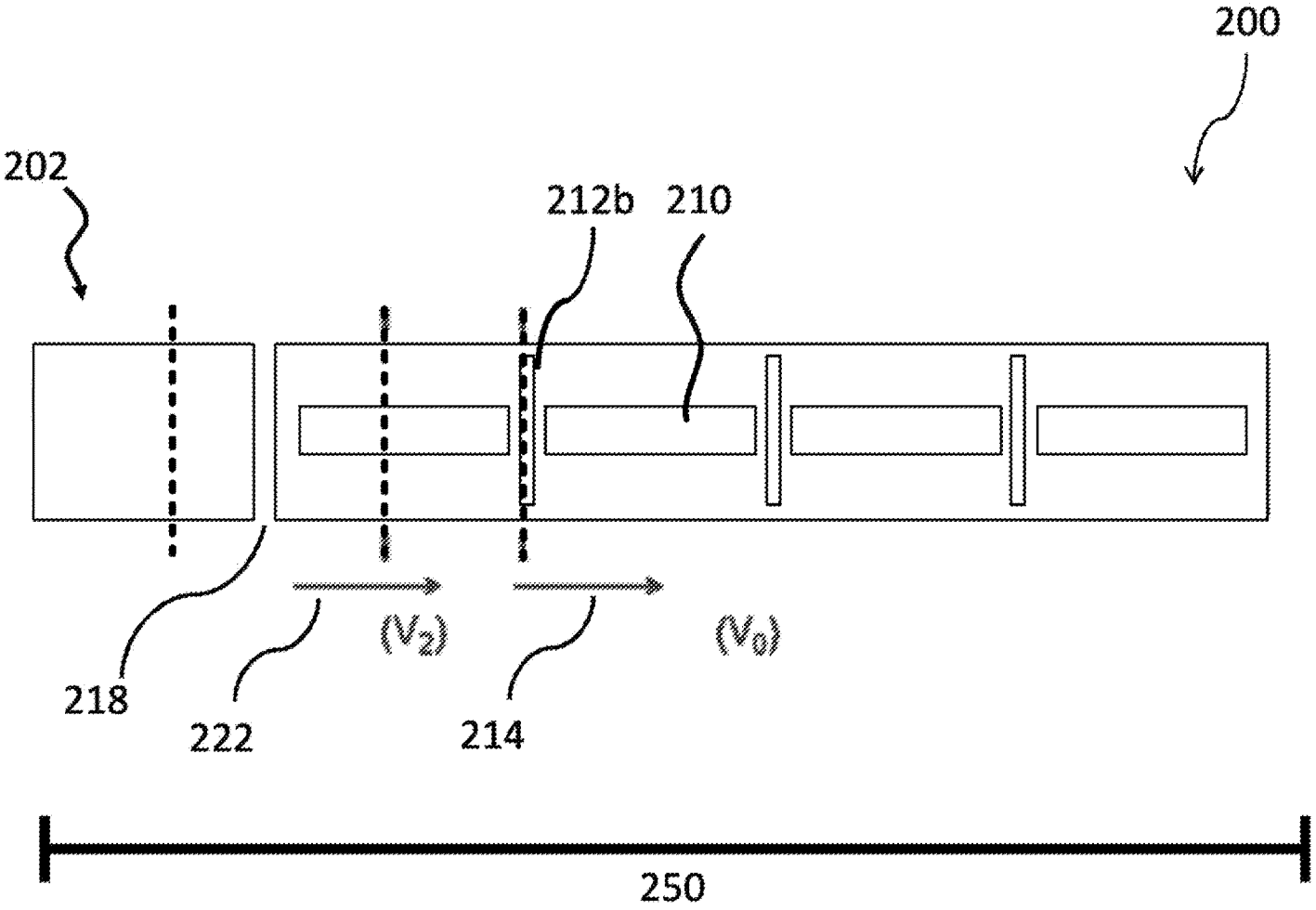
FIG. 4D is a diagrammatic view of a fragmentable perforating gun detailing initial wave interaction with a second wave manipulator, according to the present disclosure.

FIG. 4D shows the interaction of the shockwave with a second wave manipulator according to the present disclosure. The shockwave 214 travels as the energetic device 210 disposed between the first wave manipulator 212*a* and a second wave manipulator 212*b* is activated. As the shockwave 214 reaches the second wave manipulator 212*b*, the second wave manipulator 212*b* generates a second reflected wave. (Shown in FIG. E).

Figure 4E:
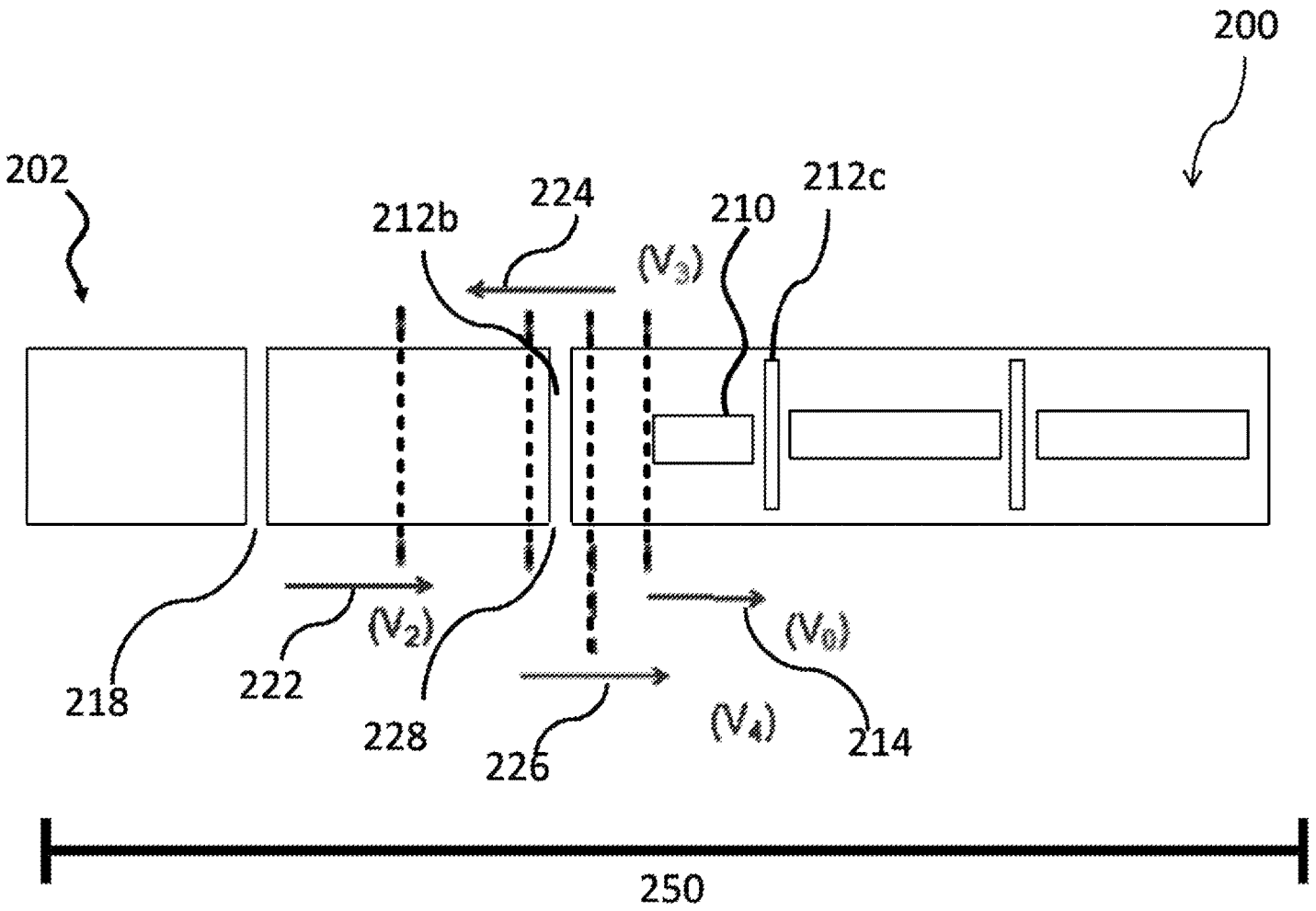
FIG. 4E is a diagrammatic view of a fragmentable perforating gun detailing a second fracture, according to the present disclosure.
Figure 4F:
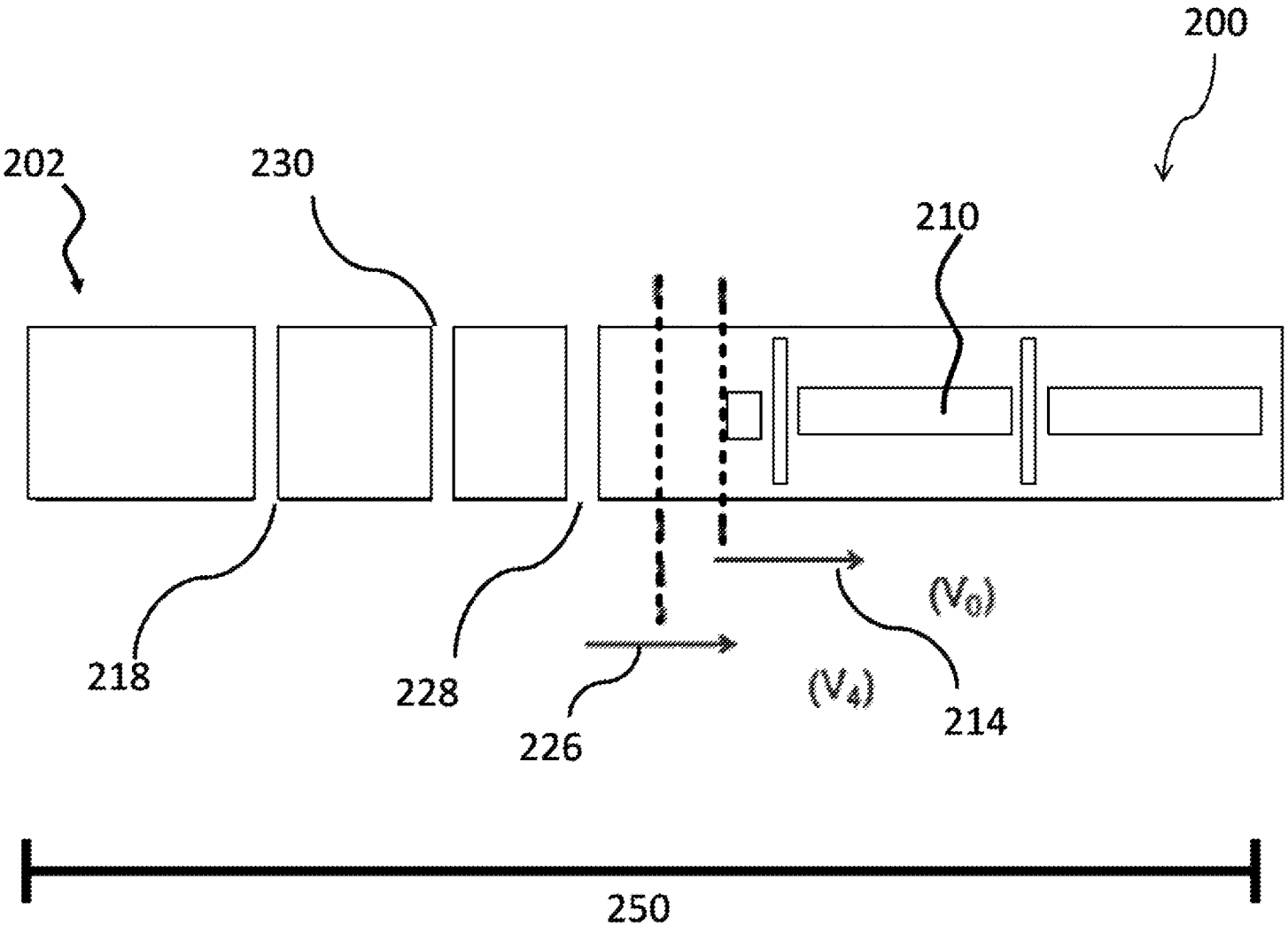
FIG. 4F is a diagrammatic view of a fragmentable perofating gun detailing a third fracture, according to the present disclosure.

FIG. 4E shows the perforating gun separating at the second wave manipulator. The second reflected wave 224, traveling at a velocity ($V_3$), generated by the second wave manipulator 212*b* induces a second tensile load, thus causing a second fracture 228. The second reflected wave 224 travels along the longitudinal length 250 of the carrier 202 in a direction opposite the shockwave 214. The second wave manipulator 212*b* allows at least a portion of the shockwave 214 to be transmitted generating a second transmitted wave 226 traveling at a velocity ($V_4$) in substantially the same direction as the shockwave 214. The shockwave 214 continues propagating along the longitudinal length 250 of the carrier as the energetic device 110 disposed between the second wave manipulator 212*b* and a third wave manipulator 212*c* is activated.

FIG. 4E shows the interaction of the transmitted wave and the second reflected wave. The transmitted wave 222 traveling at velocity ($V_2$) passes the second reflected wave 224 traveling at velocity ($V_3$) traveling in a direction substantially opposite the transmitted wave 222. The interaction between the transmitted wave 222 and the second reflected wave 224 induces a tensile load along the longitudinal length 250 of the carrier inducing a third fracture 230.

The third fracture 230 is formed at the collision point between the transmitted wave 222 and the second reflected wave 224. The collision point between these two waves depends on the velocity of each, $V_2$ and $V_3$, and thus can vary depending on the particular applications being implemented. The collision point can be controlled by selection of the one or more wave manipulator 212 and selection of the one or more energetic devices 210. In at least one instance, the third fracture 230 forms substantially equidistant between the first fracture 216 and the second fracture 228. In other instances, the third fracture 230 can form closer to the third wave manipulator 212*c* or closer to the second wave manipulator 212*b*.

The process continues along the longitudinal length 250 of the carrier 202, forming a fracture at each wave manipulator 212 at the interaction between a shockwave and a reflected wave. Additional fractures can be formed between each wave manipulator 212 at the interaction of a transmitted wave and reflected wave.

Figure 4G:
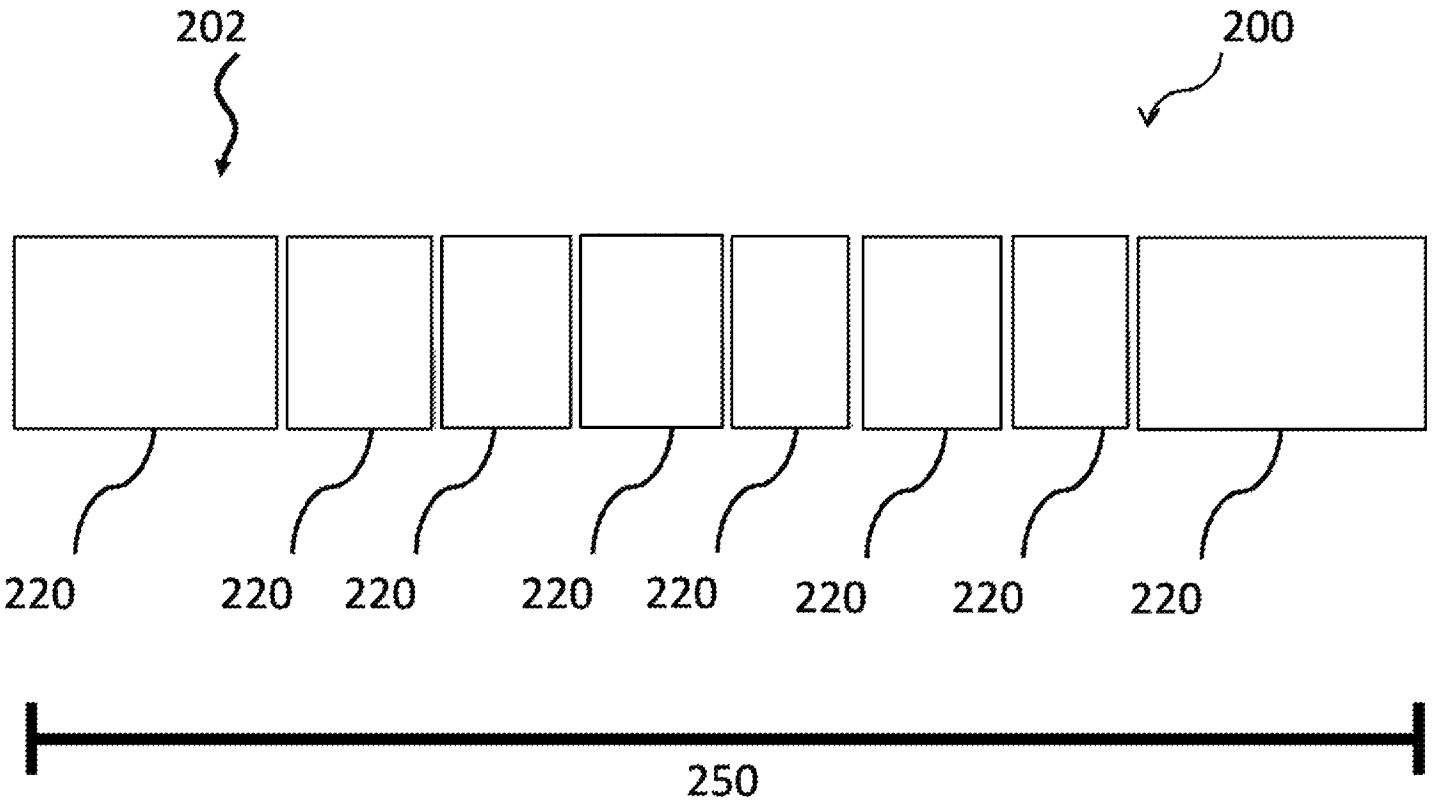
FIG. 4G is a diagrammatic view of fragmented perforating gun, according to the present disclosure.

FIG. 4G shows a separated perforating gun. The perforating gun 200 can be fractured, or separated, into a plurality of pieces 220 through the formation of fractures 218, 228, 230, 232, 234, 236, 238 along the longitudinal length 250 of the carrier 202. The pieces 220 can be of any size depending on the number and type of wave manipulators 212 formed in the carrier 202 and the overall length and size of the perforating gun 200. The size and shape of the plurality of pieces 220 can vary depending on the shape of the one or more energetic devices 210, the material selection of the carrier 202, and/or the design of the one or more wave manipulators 212. The carrier is fractured, or separated, into pieces of sufficient size to prevent obstruction of the wellbore without having to remove the perforating gun 200. The plurality of pieces 220 can travel to the bottom of the wellbore, past the desired perforating zone.

Figure 5B:
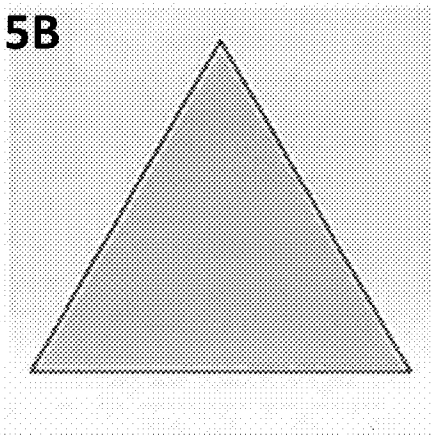
FIG. 5B is diagrammatic view of a second example wave manipulator, according to the present disclosure.
Figure 5D:
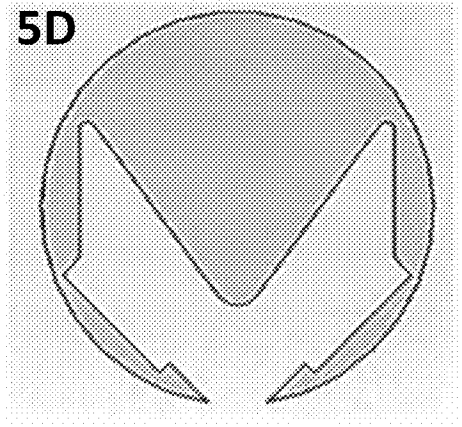
FIG. 5D is diagrammatic view of a fourth example wave manipulator, according to the present disclosure.
Figure 5A:
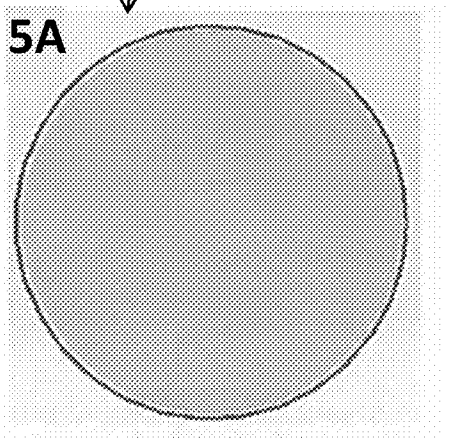
FIG. 5A is diagrammatic view of a first example wave manipulator, according to the present disclosure.
Figure 5C:
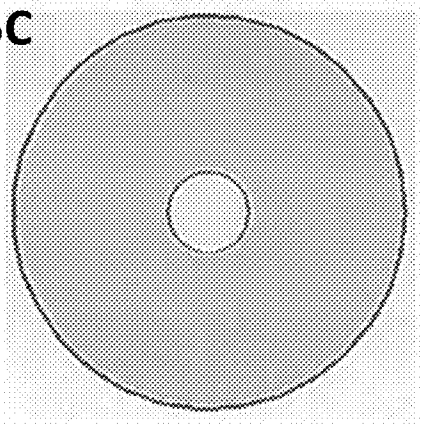
FIG. 5C is diagrammatic view of a third example wave manipulator, according to the present disclosure.

FIGS. 5A-5D shows example profiles of a wave manipulator. FIGS. 5A and 5B detail the shape of the one or more wave manipulators 112 or 212, specifically the one or more wave manipulators 112, 212 can be any shape with any number of sides.

The wave manipulation perforating gun 100 can be any size, shape, and/or cross-sectional profile sufficient to be lowered into a wellbore of a subterranean formation. The one or more wave manipulators 112, 212 disposed within the perforating gun 100 can allow the one or more energetic devices to pass through substantially the center along a longitudinal axis, as detailed in FIG. 5C. The energetic material as detailed in FIG. 5C can be detonation cord. The one or more wave manipulators 112, 212, as detailed in FIG. 5D, can also allow energetic materials to be directly coupled with therewith. The one or more wave manipulators 112, 212 can be formed from any number of materials including, but not limited to, steel, tungsten, polymers, plastics, wood, etc.

The faces of the wave manipulators 112, 212 can also be lined with energetic materials, such as detasheet, that can supplement the reflected and/or transmitted waves with their own respective mechanical wave. The one or more wave manipulators 112, 212 can also be made entirely of energetic material, allowing for consumption during a perforating event. The wave manipulators 112, 212 can be placed so as to at least partially circumscribes the one or more energetic devices or are placed at the boundary (end) of the energetic device. The one or more wave manipulators 112, 212 can be oriented parallel or perpendicular to the longitudinal length of the perforating gun 100.

The wave manipulator perforating gun 100 can have a solid energetic device 110 placed down the carrier, such that detonation of the energetic device moves down the energetic material and an associated wave moves down the internal free volume of the carrier 102. The cross-section of the energetic device 110 can be varied along the longitudinal length 150 of the carrier 102. This change in cross-section can create a surface boundary for transmission waves to reflect, creating a corresponding reflecting wave to be translated into the carrier 102. The cross-section can be varied by a void, or pocket, filled with non-energetic material or an energetic material with a different reaction rate. In at least one instance, a series of solid energetic materials can be spaced out within the carrier 102 and a reaction energy transmission is placed between the energetic materials. The discontinuity created by the free surface of the energetic material creates the same transmission/reflection phenomenon.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

Statement of the Claims:

Statement 1: A perforating gun, comprising a carrier having a longitudinal length, one or more energetic devices received within the carrier configured to produce one or more mechanical waves, one or more wave manipulators disposed along the longitudinal length of the carrier, wherein the one or more wave manipulators generate an altered wave in an opposite travel direction of one or more mechanical waves traveling along the longitudinal length of the carrier.

Statement 2: The perforating gun of Statement 1, wherein activation of the one or more energetic devices generate the one or more mechanical waves within the carrier.

Statement 3: The perforating gun of Statement 1 or Statement 2, wherein the one or more mechanical waves within the carrier are one or more shockwaves.

Statement 4: The perforating gun of any one of the preceding Statements 1-3, wherein the interaction between one of the one or more mechanical waves and an altered wave generated by a wave manipulator of the one or more wave manipulator induces a tensile load at the wave manipulator and along the longitudinal length of the carrier.

Statement 5: The perforating gun of any one of the preceding Statements 1-4, wherein the induced tensile load fractures the carrier at the wave manipulator and along the longitudinal length of the carrier.

Statement 6: The perforating gun of any one of the preceding Statements 1-5, wherein the one or more wave manipulators generate a transmitted wave travelling in substantially the same direction as the one or more mechanical waves.

Statement 7: The perforating gun of any one of the preceding Statements 1-6, wherein a second tensile load is induced at the collision of the altered wave and the transmitted wave.

Statement 8: The perforating gun of any one of the preceding Statements 1-7, wherein the induced second tensile load fractures the carrier at the collision of the altered wave and the transmitted wave.

Statement 9: The perforating gun of any one of the preceding Statements 1-8, wherein the one or more energetic devices are shaped charges.

Statement 10: The perforating gun of any one of the preceding Statements 1-9, wherein the one or more energetic devices are detonation chord.

Statement 11. A perforating gun system, comprising a completion string, the completion string including a separable perforating gun disposed at a distal end, the separable perforating gun comprising a carrier having a longitudinal length, one or more energetic devices received within the carrier configured to produce one or more mechanical waves, one or more wave manipulators disposed along the longitudinal length of the carrier, wherein the one or more wave manipulators generate an altered wave in an opposite travel direction of one or more mechanical waves traveling along the longitudinal length of the carrier.

Statement 12: The perforating gun system of Statement 11, wherein activation of the one or more energetic devices generate the one or more mechanical waves within the carrier.

Statement 13: The perforating gun system of Statement 11 or Statement 12, wherein the interaction between one of the one or more mechanical waves and an altered wave generated by a wave manipulator of the one or more wave manipulator induces a tensile load at the wave manipulator and along the longitudinal length of the carrier.

Statement 14. The perforating gun system of any one of the preceding Statements 11-13, wherein the induced tensile load fractures the carrier at the wave manipulator and along the longitudinal length of the carrier.

Statement 15: The perforating gun system of any one of the preceding Statements 11-14, wherein the one or more wave manipulators generate a transmitted wave travelling in substantially the same direction as the one or more mechanical waves.

Statement 16: The perforating gun system of any one of the preceding Statements 11-15, wherein a second tensile load is induced at the collision of the altered wave and the transmitted wave.

Statement 17: The perforating gun system of any one of the preceding Statements 11-16, wherein the induced second tensile load fractures the carrier at the collision of the altered wave and the transmitted wave.

Statement 18: A method for a separable perforating gun, the method comprising placing a separable perforating gun in a subterranean formation, energizing one or more energetic devices disposed within a carrier of the separable perforating gun to produce a mechanical wave, the mechanical wave traveling long a longitudinal length of the carrier, generating a manipulated wave at a wave manipulator disposed along the longitudinal length of the carrier, the manipulated wave traveling in a direction substantially opposite to the mechanical wave, and inducing a tensile load in the carrier at the interaction of the manipulated wave and the mechanical wave, the tensile load fracturing the carrier of the separable perforating gun.

Statement 19: The method of Statement 18, further comprising generating a transmitted wave at the wave manipulator, the transmitted wave travelling in substantially the same direction as the mechanical wave.

Statement 20. The method of Statement 18 or Statement 19, further comprising inducing a second tensile load at the interaction of the transmitted wave and the reflected wave, the second tensile load creating a second fracture in the carrier of the separable perforating gun.

Statement 21: A downhole tool, comprising a carrier having a longitudinal length, one or more energetic devices received within the carrier configured to produce one or more mechanical waves, one or more wave manipulators disposed along the longitudinal length of the carrier, wherein the one or more wave manipulators generate an altered wave in an opposite travel direction of one or more mechanical waves traveling along the longitudinal length of the carrier.

Statement 22: The downhole tool of Statement 21, wherein activation of the one or more energetic devices generate the one or more mechanical waves within the carrier.

Statement 23: The downhole tool of Statement 21 or Statement 22, wherein the one or more mechanical waves within the carrier are one or more shockwaves.

Statement 24: The downhole tool of any one of the preceding Statements 21-23, wherein the interaction between one of the one or more mechanical waves and an altered wave generated by a wave manipulator of the one or more wave manipulator induces a tensile load at the wave manipulator and along the longitudinal length of the carrier.

Statement 25: The downhole tool of any one of the preceding Statements 21-24, wherein the induced tensile load fractures the carrier at the wave manipulator and along the longitudinal length of the carrier.

Statement 26: The downhole tool of any one of the preceding Statements 21-25, wherein the one or more wave manipulators generate a transmitted wave travelling in substantially the same direction as the one or more mechanical waves.

Statement 27: The downhole tool of any one of the preceding Statements 21-26, wherein a second tensile load is induced at the collision of the altered wave and the transmitted wave.

Statement 28: The downhole tool of any one of the preceding Statements 21-27, wherein the induced second tensile load fractures the carrier at the collision of the altered wave and the transmitted wave.

Statement 29: The downhole tool of any one of the preceding Statements 21-28, wherein the one or more energetic devices are shaped charges.

Statement 30: The downhole tool of any one of the preceding Statements 21-29, wherein the one or more energetic devices are detonation chord.

What is claimed is:

1. A perforating gun, comprising:

a carrier having a longitudinal length;

one or more energetic devices received within the carrier configured to produce one or more mechanical waves; and one or more wave manipulators disposed along the longitudinal length of the carrier;

wherein the one or more wave manipulators manipulate the one or more mechanical waves to generate an altered wave in an opposite travel direction of one or more of the mechanical waves traveling along the longitudinal length of the carrier when the one or more mechanical waves are generated by the one or more energetic devices, wherein the interaction between one of the one or more mechanical waves and an altered wave generated by a wave manipulator of the one or more wave manipulator induces a first tensile load at the wave manipulator and along the longitudinal length of the carrier, and wherein the induced first tensile load fractures the carrier at the wave manipulator and along the longitudinal length of the carrier.

2. The perforating gun of claim 1, wherein activation of the one or more energetic devices generate the one or more mechanical waves within the carrier.

3. The perforating gun of claim 1, wherein the one or more mechanical waves within the carrier are one or more shockwaves.

4. The perforating gun of claim 1, wherein the one or more wave manipulators generate a transmitted wave travelling in the same direction as the one or more mechanical waves.

5. The perforating gun of claim 4, wherein a second tensile load is induced at the collision of the altered wave and the transmitted wave.

6. The perforating gun of claim 5, wherein the induced second tensile load fractures the carrier at the collision of the altered wave and the transmitted wave.

7. The perforating gun of claim 1, wherein the one or more energetic devices are shaped charges.

8. The perforating gun of claim 1, wherein the one or more energetic devices are detonation chord.

9. A perforating gun system, comprising:

a completion string, the completion string including a separable perforating gun disposed at a distal end, the separable perforating gun comprising:

a carrier having a longitudinal length;

one or more energetic devices received within the carrier configured to produce one or more mechanical waves; and one or more wave manipulators disposed along the longitudinal length of the carrier;

wherein the one or more wave manipulators manipulate the one or more mechanical waves to generate an altered wave in an opposite travel direction of one or more mechanical waves traveling along the longitudinal length of the carrier, wherein the interaction between one of the one or more mechanical waves and an altered wave generated by a wave manipulator of the one or more wave manipulator induces a first tensile load at the wave manipulator and along the longitudinal length of the carrier, wherein the induced first tensile load fractures the carrier at the wave manipulator and along the longitudinal length of the carrier.

10. The perforating gun system of claim 9, wherein activation of the one or more energetic devices generate the one or more mechanical waves within the carrier.

11. The perforating gun system of claim 9, wherein the one or more wave manipulators generate a transmitted wave travelling in the same direction as the one or more mechanical waves.

12. The perforating gun system of claim 11, wherein a second tensile load is induced at the collision of the altered wave and the transmitted wave.

13. The perforating gun system of claim 12, wherein the induced second tensile load fractures the carrier at the collision of the altered wave and the transmitted wave.

14. A method comprising:

placing a separable perforating gun in a subterranean formation;

energizing one or more energetic devices disposed within a carrier of the separable perforating gun to produce a mechanical wave, the mechanical wave traveling long a longitudinal length of the carrier; and generating a manipulated wave from the mechanical wave at a wave manipulator disposed along the longitudinal length of the carrier, the manipulated wave traveling in a direction opposite to the mechanical wave;

wherein the interaction between the mechanical wave and the manipulated wave generated by a wave manipulator induces a tensile load at the wave manipulator and along the longitudinal length of the carrier, and wherein the induced tensile load fractures the carrier at the wave manipulator and along the longitudinal length of the carrier.

15. The method of claim 14, further comprising generating a transmitted wave at the wave manipulator, the transmitted wave travelling in the same direction as the mechanical wave.

16. The method of claim 15, further comprising inducing a second tensile load at the interaction of the transmitted wave and a reflected wave, the second tensile load creating a second fracture in the carrier of the separable perforating gun.

* * * * *